United States Patent [19]

Pfarr, Jr.

[11] 3,993,288

[45] Nov. 23, 1976

[54] BAND TENSIONING DEVICE

[75] Inventor: Walter L. Pfarr, Jr., Towson, Md.

[73] Assignee: Anchor Post Products Inc., Baltimore, Md.

[22] Filed: Oct. 10, 1975

[21] Appl. No.: 621,435

Related U.S. Application Data

[63] Continuation of Ser. No. 538,314, Jan. 3, 1975, abandoned.

[52] U.S. Cl. ..... 256/47; 24/73 R

[51] Int. Cl.[2] ..... B21F 27/00

[58] Field of Search ..... 256/47; 24/73 R

[56] References Cited

UNITED STATES PATENTS

| | | | |
|---|---|---|---|
| 2,267,586 | 12/1941 | DelCamp | 24/73 |
| 2,997,278 | 8/1961 | Pinson | 256/47 |
| 3,022,044 | 2/1962 | Gugino | 256/47 |

*Primary Examiner*—Werner H. Schroeder
*Assistant Examiner*—Doris L. Troutman
*Attorney, Agent, or Firm*—Walter G. Finch

[57] ABSTRACT

A new and improved band tensioning device or clamp is provided for securing and maintaining the required tension of chain link fences or the like. This clamp consists of a flat strip of cut metal formed into a U-shape.

The closed end of the clamp is placed around a fence post and the two arms with curved ends are pressed together and locked around a tension bar which has been threaded through a chain fabric type fence.

3 Claims, 5 Drawing Figures

BAND TENSIONING DEVICE

This is a continuation of application Ser. No. 538,314, filed Jan. 3, 1975, now abandoned.

This invention relates generaly to band tensioning devices, and more particularly it pertains to clamps or bands designed to secure and maintain the proper tension of chain fabric type fences or the like.

At present, most of the clamps that are used to secure chain fabric type fences require a metal band with a bolt and a nut.

It is the object of this invention, therefore, to provide a one-piece band tensioning device or clamp that does not require a bolt and nut to secure it.

A still further object of this invention is to provide a band tensioning device or clamp that is more economical to make and quicker and easier to install.

A still further object of this invention is to provide a band tensioning device or clamp that can be installed on various sizes and types of fence posts and tension bars.

Other objects and attendant advantages of this invention will become more readily apparent and understood from the detailed specification and accompanying drawings in which.

Figure 3:
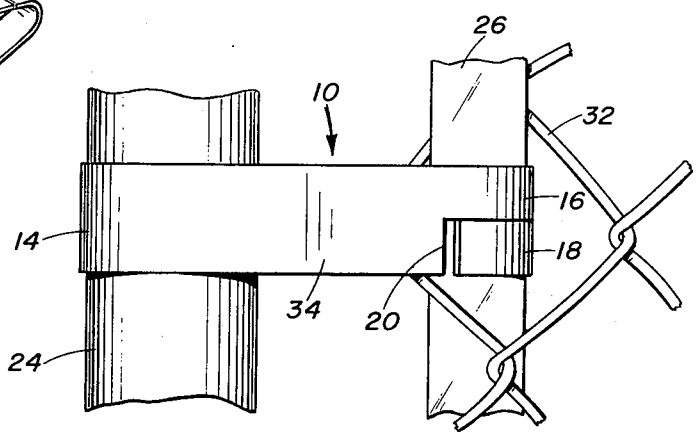
FIG. 3 is a partial side elevation view showing the band tensioning device or clamp installed on a chain link fabric type fence.
Figure 2:
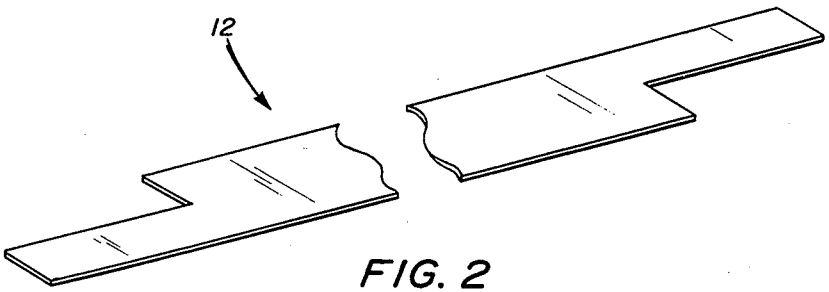
FIG. 2 is a perspective view showing a cut-out blank used to make the band tensioning device or clamp of FIG. 1.
Figure 1:
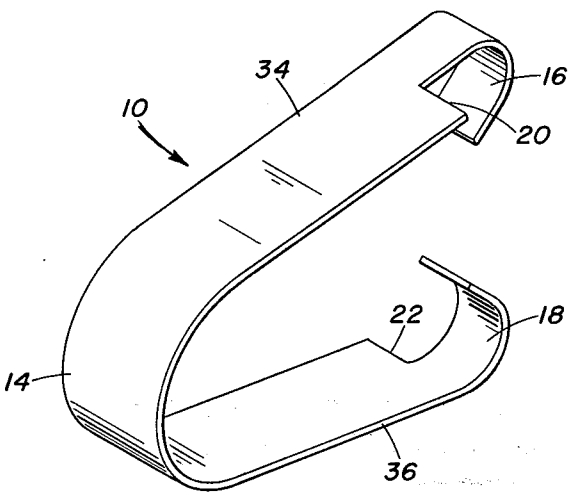
FIG. 1 is a perspective view of a band tensioning device or clamp incorporating features of this invention.

Referring now to the drawings in which like reference numbers refer to like parts in all figures, the band tensioning device or complete clamp 10 is shown in FIG. 1. This band tensioning device or clamp is made from a metal cut blank 12 as shown in FIG. 2. The clamp 10 is formed into a U-shape with a closed end 14, two arms 34 and 36, with curved ends 16 and 18. There are two cut out sections 20 and 22 on opposite sides of the arms 34 and 36 which allows the open end of the clamp 10 to lock together after it is installed on a chain type fence as shown in FIG. 3.

If desired, the blank 12 of FIG. 2 can be made with other blank shapes such as angled ends to fit the required design conditions. Other shapes can be used for the blank 12. For example, the blank 12 can be a total rectangle and when formed the ends can be overlapped.

The installation of the clamp 10 is accomplished by slipping the closed end of the clamp 10 around, for example, a fence post 24 and clamping the two ends 16 and 18 around a tension bar 26 which has been threaded through the chain link fabric 32. The two cut-out sections 20 and 22 allow the two curved ends 16 and 18 to interlock. The chain link fabric 32 is pulled to a proper tension causing the clamp 10 to pull against the tension bar 26, thus providing a secure clamping action.

Figure 4:
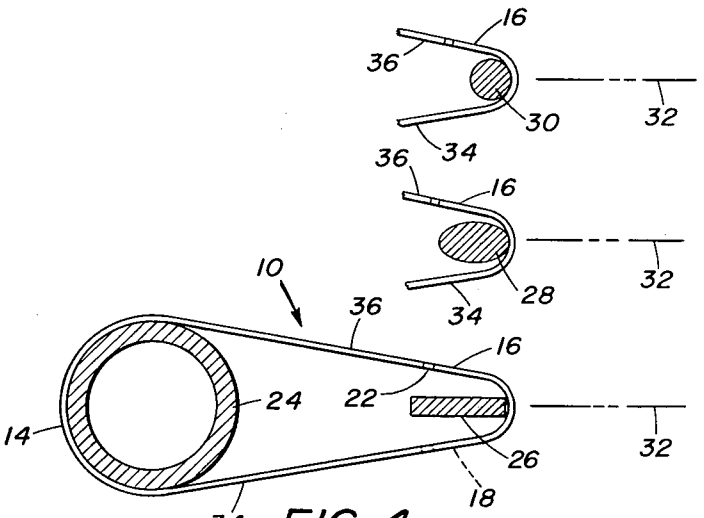
FIG. 4 is a partial top view of FIG. 3, showing three types of tension rods.

In FIG. 4, there are shown three various types of tension bars, flat 26, oval 28, and round 30, which can be sued for securing the chain link fabric to the post 24. The tensioning band of FIG. 4 is intended to be used for gate clips on gates where the fence post 24 is rather small. On larger posts, however, it is important to have the chain link fabric and the tension bar 26 aligned closer to the outside face of the post 24. This produces an offset band.

The size and thickness of the metal clamp is determined by the application of same.

Figure 5:
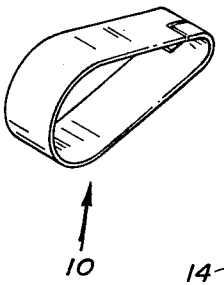
FIG. 5 shows a modified tensioning band in a closed position.

FIG. 5 shows a modified tensioning band in a closed position. For heavy duty fences, the bands 10 are made of thicker metal and are performed in the closed position. Installation of the tensioning band 10 is by slipping the band 10 over the post 24 and then inserting the tension rod 26 through the band 10.

The heavier bands 10 of FIG. 5 must be manufactured in the closed position because the material can not be readily formed in the field when made of heavy materials. In this case, and as previously mentioned, the band 10 is positioned onto the post 24 by placing it over the top end of the post 24 after installation and before any post arms are attached.

Obviously many modifications and variations of the present invention are possible in light of the above teachings. It is, therefore, to be understood that within the scope of the appended claims the invention may be practiced otherwise than as specifically described.

What is claimed is:

1. In combination, a pair of spaced vertical members and a band tensioning device for holding said pair of spaced vertical members together to keep said pair of spaced vertical members from moving apart from each other, said band tensioning device comprising:

a substantially elongated U-shaped member formed of a flat strip of metal and having a closed end from which spaced legs extend in essentially the same direction, the closed end engaging about one of said pair of spaced vertical members;

an arm extending outwardly from each of the spaced legs of the U-shaped member, each arm terminating in a inwardly projecting curved end portion, each end portion having a longitudinal axis which extends toward the interior of the U-shaped member and lies along the interior surface of the arm from which said end portion extends, each end portion terminating prior to crossing intersection with the end portion on the other arm, each end portion of said arms having a complementary cut-out section along opposite edges of said arms which allow the end portions to lock about the other of said pair of spaced vertical members after the device is installed between said pair of spaced vertical members, the pair of spaced vertical members being received within the unobstructed spatial confines of the device defined by the closed end, the arms, and the interlocked inwardly curving end portions.

2. The combination as recited in claim 1, wherein chain link fabric is secured to the other of said pair of spaced vertical members.

3. The combination as recited in claim 1, wherein said cut out sections along opposite edges of said arms are of rectangular shape.

* * * * *